US012195913B2

(12) United States Patent
Ashida et al.

(10) Patent No.: US 12,195,913 B2
(45) Date of Patent: Jan. 14, 2025

(54) GRAIN-FINISHED LEATHER-LIKE SHEET AND EVALUATION METHOD FOR GRAIN-FINISHED LEATHER-LIKE SHEET

(71) Applicant: KURARAY CO., LTD., Kurashiki (JP)

(72) Inventors: Tetsuya Ashida, Osaka (JP); Kansai Hara, Osaka (JP)

(73) Assignee: KURARAY CO., LTD., Kurashiki (JP)

( * ) Notice: Subject to any disclaimer, the term of this patent is extended or adjusted under 35 U.S.C. 154(b) by 284 days.

(21) Appl. No.: 17/440,820

(22) PCT Filed: Mar. 11, 2020

(86) PCT No.: PCT/JP2020/010610

§ 371 (c)(1),
(2) Date: Sep. 20, 2021

(87) PCT Pub. No.: WO2020/195850

PCT Pub. Date: Oct. 1, 2020

(65) Prior Publication Data

US 2022/0186430 A1 Jun. 16, 2022

(30) Foreign Application Priority Data

Mar. 27, 2019 (JP) ..... 2019-061661

(51) Int. Cl.
*D06N 3/14* (2006.01)
*D06N 3/00* (2006.01)

(52) U.S. Cl.
CPC ..... *D06N 3/145* (2013.01); *D06N 3/0065* (2013.01); *D06N 2211/28* (2013.01); *D06N 2213/03* (2013.01)

(58) Field of Classification Search
CPC ..... D06N 3/0065; D06N 3/145; D06N 2209/0861; D06N 3/14–148
See application file for complete search history.

(56) References Cited

U.S. PATENT DOCUMENTS

2006/0035556 A1* 2/2006 Yokoi ..... D06N 3/14 442/403
2007/0231546 A1 10/2007 Xia et al.
(Continued)

FOREIGN PATENT DOCUMENTS

CN 101736604 A 6/2010
EP 0477963 A2 4/1992
(Continued)

OTHER PUBLICATIONS

"JPH11158782_Machine Translation" is a machine translation of JP-H11158782-A. (Year: 1999).*
(Continued)

*Primary Examiner* — Larissa Rowe Emrich
(74) *Attorney, Agent, or Firm* — Element IP, PLC

(57) ABSTRACT

Disclosed is a grain-finished leather-like sheet including: a fiber base material; and a polyurethane skin film stacked, as a surface layer, directly on the fiber base material or via another polyurethane layer, wherein the polyurethane skin film contains at least one of a diketopyrrolopyrrole-based red pigment and an α-type phthalocyanine-based blue pigment, the grain-finished leather-like sheet further includes a clear polyurethane film layer coating the polyurethane skin film, and the grain-finished leather-like sheet has a grade of color difference, determined using a Grey scale for assessing staining, of 4-5 or more, when 0.03 g of oleic acid is added dropwise to a surface of the clear polyurethane film layer, and thereafter a white cotton fabric is reciprocated 100 times on the surface, using a crockmeter.

12 Claims, 1 Drawing Sheet

(56) References Cited

U.S. PATENT DOCUMENTS

| | | | | |
|---|---|---|---|---|
| 2010/0086738 | A1* | 4/2010 | Tanaka | D06N 3/14 473/607 |
| 2011/0008575 | A1 | 1/2011 | Sasaki et al. | |
| 2012/0238701 | A1 | 9/2012 | Yamada et al. | |
| 2014/0242864 | A1* | 8/2014 | Jung | D06N 3/128 442/71 |

FOREIGN PATENT DOCUMENTS

| | | | | |
|---|---|---|---|---|
| EP | 2133463 | A1 | | 12/2009 |
| JP | S542301 | A | | 1/1979 |
| JP | S58-63749 | A | | 4/1983 |
| JP | H05-25781 | A | | 2/1993 |
| JP | H06206965 | A | | 7/1994 |
| JP | H11158782 | A | * | 6/1999 |
| JP | 2000248472 | A | * | 9/2000 |
| JP | 2006037254 | A | | 2/2006 |
| JP | 2011052336 | A | | 3/2011 |
| JP | 2013231268 | A | | 11/2013 |
| JP | 2015168907 | A | * | 9/2015 |
| WO | WO-2004015194 | A1 | | 2/2004 |
| WO | WO-2009107246 | A1 | | 9/2009 |
| WO | WO-2011058937 | A1 | | 5/2011 |

OTHER PUBLICATIONS

"JP2000248472_Machine Translation" is a machine translation of JP-2000248472-A. (Year: 2000).*

"JP2015168907_Machine Translation" is a machine translation of JP-2015168907-A. (Year: 2015).*

Extended European Search Report issued Nov. 21, 2022 in Patent Application No. 20779200.3, 8 pages.

International Search Report issued Jun. 9, 2020 in PCT/JP2020/010610 (with English translation), 6 pages.

* cited by examiner

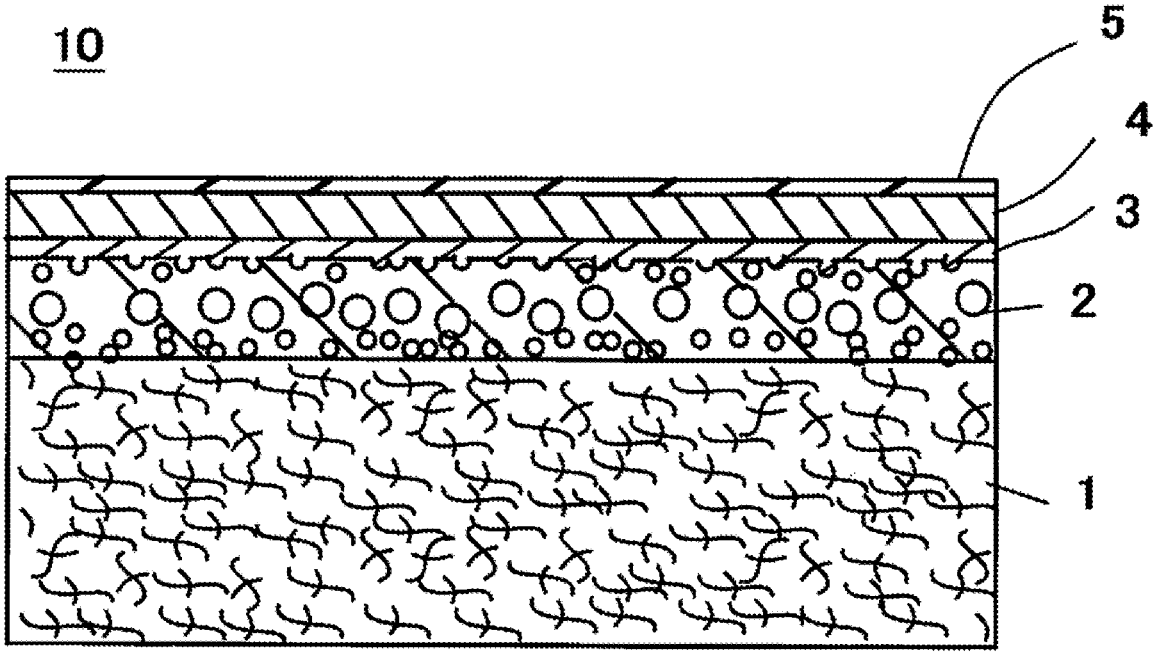
10
5
4
3
2
1

GRAIN-FINISHED LEATHER-LIKE SHEET AND EVALUATION METHOD FOR GRAIN-FINISHED LEATHER-LIKE SHEET

TECHNICAL FIELD

The present invention relates to a grain-finished leather-like sheet that is excellent in resistance to color migration to clothing, and an evaluation method for color migration of a grain-finished leather-like sheet to clothing due to sebum.

BACKGROUND ART

A grain-finished leather-like sheet including a fiber base material, and a grain-finished resin layer stacked on the fiber base material is known as a grain-finished leather-like sheet, which has a grain-finished external appearance resembling that of a natural leather, used as a skin material of bags, clothing, shoes, and the like. Such a grain-finished leather-like sheet has the problem of color loss under various situations.

For example, PTL 1 listed below discloses a leather-like sheet that is less likely to cause color loss even when it is in contact with alcohol and that can maintain good bendability. Specifically, PTL 1 discloses a leather-like sheet that includes a grain layer containing a colorant, with a specific silicone-modified polyurethane resin applied in the form of dots on the grain layer surface by gravure coating.

In addition, PTL 2 listed below discloses a leather-like sheet that is bright and causes little color migration. PTL 2 discloses a leather-like sheet that causes little color migration, and that includes a sheet colored with a metal complex salt dye, and a polymer layer provided on the sheet, the polymer layer formed mainly of a methacrylic acid resin and/or nitrocellulose and having a thickness of 0.2 to 3 microns.

CITATION LIST

Patent Literatures

[PTL 1] Japanese Laid-Open Patent Publication No. 2011-52336

[PTL 2] Japanese Laid-Open Patent Publication No. S54-002301

SUMMARY OF INVENTION

Technical Problem

Grain-finished leather-like sheets are preferably used as the materials of "Randoseru"s (elementary school bags in Japan) colored in bright red, blue or the like. For example, when a grain-finished leather-like sheet colored in red, blue, or the like is used for the back lining of a Randoseru, the back lining of the Randoseru occasionally causes color migration by being rubbed against the clothing of a person. As a result of conducting various studies for identifying the cause of the color migration to clothing, the present inventors have found that a grain-finished leather-like sheet containing a diketopyrrolopyrrole-based red pigment or an α-type phthalocyanine-based blue pigment is likely to cause color migration under the effect of the sebum contained in clothing. Note that in the case of using, for example, a β-type phthalocyanine-based blue pigment, the color migration to clothing is less likely to occur.

It is an object of the present invention to provide a grain-finished leather-like sheet that is less likely to cause color migration to clothing under the effect of sebum, the grain-finished leather-like sheet including a polyurethane skin film colored with a colorant including a diketopyrrolopyrrole-based red pigment or an α-type phthalocyanine-based blue pigment.

Solution to Problem

A grain-finished leather-like sheet including a polyurethane skin film colored with a diketopyrrolopyrrole-based red pigment or an α-type phthalocyanine-based blue pigment develops a bright color. However, the present inventors have found that a grain-finished leather-like sheet including a polyurethane skin film colored with any of these pigments is particularly likely to cause color migration. Then, as a result of analyzing clothing to which color has migrated, the present inventors have found that the amount of sebum contained in the clothing is larger than that contained in normal clothing. Based on such findings, the present inventors have obtained a result that color is likely to migrate to clothing containing a large amount of sebum, and have found an evaluation method for color migration to clothing under the effect of sebum, thus arriving at the present invention.

That is, an aspect of the present invention is directed to a grain-finished leather-like sheet including: a fiber base material; and a polyurethane skin film stacked, as a surface layer, directly on the fiber base material or via another polyurethane layer, wherein the polyurethane skin film contains at least one of a diketopyrrolopyrrole-based red pigment and an α-type phthalocyanine-based blue pigment, the grain-finished leather-like sheet further includes a clear polyurethane film layer coating the polyurethane skin film, and the grain-finished leather-like sheet has a grade of color difference, determined using a Grey scale for assessing staining defined in JIS L 0805, of 4-5 or more, when 0.03 g of oleic acid is added dropwise to a surface of the clear polyurethane film layer, and thereafter a white cotton fabric is reciprocated 100 times on the surface under a load of 9 N and at 20° C., a friction distance of 10 cm, and a friction speed of one reciprocation per second, using a crockmeter compliant with JIS L 0849. With such a grain-finished leather-like sheet, the clear polyurethane film layer is formed on the surface of the polyurethane skin film containing a diketopyrrolopyrrole-based red pigment or an α-type phthalocyanine-based blue pigment such that the grain-finished leather-like sheet has a grade of color difference of 4-5 or more, in the above-described test using oleic acid. Thus, it is possible to obtain a grain-finished leather-like sheet that is less likely to cause color migration of the diketopyrrolopyrrole-based red pigment or the α-type phthalocyanine-based blue pigment to clothing under the effect of sebum.

It is preferable that the clear polyurethane film layer contains a silicone-modified polyurethane, from the viewpoint that the color migration to clothing under the effect of sebum can be particularly suppressed.

It is preferable that the polyurethane skin film contains 1 to 8 mass % of the diketopyrrolopyrrole-based red pigment, or contains 2 to 15 mass % of the α-type phthalocyanine-based blue pigment, from the viewpoint that the effects of the present invention become prominent.

Another aspect of the present invention is directed to an evaluation method for a grain-finished leather-like sheet, including the steps of: adding dropwise oleic acid to a surface of a colored grain-finished leather-like sheet; and reciprocating, using a crockmeter, a white cotton fabric a predetermined number of times on the surface of the grain-finished leather-like sheet to which the oleic acid has been added dropwise, and thereafter determining a grade of color difference of the grain-finished leather-like sheet, using a Grey scale for assessing staining defined in JIS L 0805. With such an evaluation method, it is possible to objectively evaluate the color migration of a grain-finished leather-like sheet to clothing under the effect of sebum.

Advantageous Effects of Invention

According to the present invention, it is possible to obtain a grain-finished leather-like sheet that is less likely to cause color migration to clothing under the effect of sebum, the grain-finished leather-like sheet including a polyurethane skin film colored with a colorant including a diketopyrrolopyrrole-based red pigment or an α-type phthalocyanine-based blue pigment.

BRIEF DESCRIPTION OF DRAWING(S)

FIG. 1 is a schematic cross-sectional view of a grain-finished artificial leather according to an embodiment.

DESCRIPTION OF EMBODIMENT

A grain-finished leather-like sheet according to the present invention is a grain-finished leather-like sheet including: a fiber base material; and a polyurethane skin film stacked, as a surface layer, directly on the fiber base material or via another polyurethane layer, wherein the polyurethane skin film contains at least one of a diketopyrrolopyrrole-based red pigment and an α-type phthalocyanine-based blue pigment, and the grain-finished leather-like sheet further includes a clear polyurethane film layer coating the polyurethane skin film. Also, the clear polyurethane film layer coating the polyurethane skin film is formed such that the grain-finished leather-like sheet has a grade of color difference, determined using a Grey scale for assessing staining defined in JIS L 0805, of 4-5 or more, when 0.03 g of oleic acid is added dropwise to a surface of the clear polyurethane film layer, and thereafter a white cotton fabric is reciprocated 100 times on the surface under a load of 9 N and at 20° C., a friction distance of 10 cm, and a friction speed of one reciprocation per second, using a crockmeter compliant with JIS L 0849. Hereinafter, an exemplary embodiment of the grain-finished leather-like sheet according to the present invention will be described.

FIG. 1 is a schematic cross-sectional view illustrating a layer configuration of a grain-finished artificial leather 10, which is an embodiment of a grain-finished leather-like sheet according to the present invention. The grain-finished artificial leather 10 includes a fiber base material 1, a polyurethane porous layer 2 stacked on the fiber base material 1, a polyurethane skin film 4, and a clear polyurethane film layer 5 coating the polyurethane skin film 4. The polyurethane skin film 4 contains at least one of a diketopyrrolopyrrole-based red pigment and an α-type phthalocyanine-based blue pigment. In addition, the polyurethane skin film 4 and the polyurethane porous layer 2 are bonded to each other with a polyurethane adhesion layer 3.

Note that the grain-finished leather-like sheet according to the present invention is not limited to a layer configuration as that of the grain-finished artificial leather 10, and there is no particular limitation on the grain-finished leather-like sheet as long as it has a layer configuration including at least a fiber base material, a monolayer or multilayer polyurethane skin film stacked, as a surface layer, directly on the fiber base material or via another polyurethane layer, and a clear polyurethane film layer coating the polyurethane skin film. Although the grain-finished artificial leather 10 includes the polyurethane porous layer 2, it is also possible to adopt a grain-finished artificial leather including a polyurethane non-porous layer containing a non-porous polyurethane, in place of a porous layer.

As the fiber base material, any conventionally known fiber base material used for an artificial leather and a synthetic leather, such as a non-woven fabric, a woven fabric, a knitted fabric, or a base material formed by impregnating an elastic polymer such as polyurethane or an acrylic elastic body into these fabrics, can be used without any particular limitation. The thickness of the fiber base material is also not particularly limited, but is, for example, preferably about 300 to 3000 μm, and more preferably about 500 to 1500 μm. The type of the fibers that form the fiber base material is also not particularly limited, and, for example, nylon-based fibers, polyester-based fibers, polyolefin-based fibers, and polyurethane-based fibers, and the like can be used without any particular limitation.

The fineness and the configuration of the fibers are also not particularly limited. For example, it is possible to use regular fibers having a fineness of more than 1 dtex, or ultrafine fibers having a fineness of less than 1 dtex. As for the fiber configuration, it is possible to use solid fibers, or fibers having voids, such as hollow fibers or lotus root-like fibers.

The polyurethane is obtained by polymerizing a polyurethane monomer component containing an organic polyisocyanate, a polymer polyol, and a chain extender at a predetermined molar ratio. The polyurethane is prepared, for example, as an organic solvent solution (e.g., a solution of an organic solvent such as dimethylformamide (DMF), methyl ethyl ketone, acetone, or toluene), an aqueous solution, or an emulsion during production of the grain-finished leather-like sheet.

Specific examples of the organic polyisocyanate include hardly yellowing diisocyanates, including, for example, aromatic diisocyanates such as 2,4-tolylene diisocyanate, 2,6-tolylene diisocyanate, 4,4'-diphenylmethane diisocyanate, and xylylene diisocyanate; and non-yellowing diisocyanates, including, for example, aliphatic or alicyclic diisocyanates such as hexamethylene diisocyanate, isophorone diisocyanate, norbornene diisocyanate, and 4,4'-dicyclohexyl methane diisocyanate. If necessary, a multifunctional isocyanate such as trifunctional isocyanate or tetrafunctional isocyanate may also be used. These may be used alone, or in a combination of two or more.

Specific examples of the polymer polyol include polycarbonate-based polyols such as polyhexamethylene carbonate diol, poly(3-methyl-1,5-pentylene carbonate)diol, polypentamethylene carbonate diol, and polytetramethylene carbonate diol; polyether-based polyols such as polyethylene glycol, polypropylene glycol, polytetramethylene glycol, and poly(methyl tetramethylene glycol); polyester-based polyols such as polyethylene adipate diol, polybutylene adipate diol, polypropylene adipate diol, polybutylene sebacate diol, polyhexamethylene adipate diol, poly(3-methyl-1,5-pentylene adipate)diol, poly(3-methyl-1,5-pentylene sebacate) diol, and polycaprolactone diol, or copolymers thereof. These may be used alone, or in a combination of two or more.

Specific examples of the chain extender include diamines such as hydrazine, ethylene diamine, propylene diamine, hexamethylene diamine, nonamethylene diamine, xylylene diamine, isophorone diamine, piperazine and derivatives thereof, adipic acid dihydrazide, and isophthalic acid dihydrazide; triamines such as diethylenetriamine; tetramines such as triethylene tetramine; diols such as ethylene glycol, propylene glycol, 1,4-butanediol, 1,6-hexanediol, 1,4-bis(β-hydroxyethoxy)benzene, and 1,4-cyclohexanediol; triols such as trimethylol propane; pentaols such as pentaerythritol; and amino alcohols such as amino ethyl alcohol and amino propyl alcohol. These may be used alone, or in a combination of two or more. Monoamines such as ethylamine, propylamine, and butylamine; carboxyl group-containing monoamine compounds such as 4-amino butanoic acid and 6-amino hexanoic acid; and monools such as methanol, ethanol, propanol, and butanol may be used together with the chain extender during a chain extending reaction.

The polyurethane for forming the polyurethane porous layer can be formed, for example, by applying, to the surface of the fiber base material, a solution of a polyurethane that can be wet-coagulated, and thereafter immersing the fiber base material in an aqueous coagulation bath to coagulate the porous polyurethane. Also, the polyurethane porous layer may be allowed to be impregnated into the fiber base material for the purpose of, for example, imparting the shape stability thereto. In this case, the fiber base material is impregnated with the polyurethane solution in advance, and the polyurethane solution is further coated on the fiber base material, and thereafter immersed in an aqueous coagulation bath to coagulate the polyurethane, whereby the porous polyurethane layer can also be provided inside the fiber base material.

The thickness of the polyurethane porous layer is, for example, preferably about 100 to 600 μm, and more preferably about 200 to 400 μm.

The polyurethane skin film is colored with at least one of a diketopyrrolopyrrole-based red pigment and an α-type phthalocyanine-based blue pigment. Here, the polyurethane skin film as used in the present embodiment is a colored layer composed mainly of a polyurethane, the colored layer including a coloring pigment that causes a color to appear on the surface via a clear polyurethane film layer, the coloring pigment including at least one of a diketopyrrolopyrrole-based red pigment and an α-type phthalocyanine-based blue pigment. Such a polyurethane skin film may be a monolayer, or a stack composed of, for example, two or three layers, as long as the polyurethane skin film contains at least one of a diketopyrrolopyrrole-based red pigment and an α-type phthalocyanine-based blue pigment.

A diketopyrrolopyrrole-based red pigment refers to a red pigment that has a structure as shown below, which may have a substituent as a chromophore:

[Chem. 1]

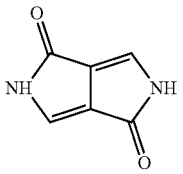

Specific examples of such a diketopyrrolopyrrole-based red pigment include Pigment Red 254, Pigment Red 255, Pigment Red 264, Pigment Orange 71, and Pigment Orange 73.

An α-type phthalocyanine-based blue pigment refers to a blue pigment that has the structure shown below, which may have a substituent as a chromophore:

[Chem. 2]

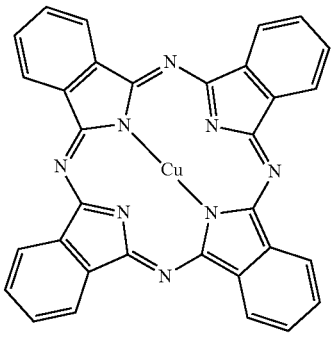

Specific examples of such an α-type phthalocyanine-based blue pigment include Pigment Blue 15:1 and Pigment Blue 15:2.

When the polyurethane skin film contains a diketopyrrolopyrrole-based red pigment, the content ratio of the diketopyrrolopyrrole-based red pigment is preferably 1 to 8 mass %, and more preferably 2 to 6 mass %, relative to the mass of the entire layer of the polyurethane skin film, from the viewpoint that the polyurethane skin film is colored brightly, and is less likely to cause color migration.

When the polyurethane skin film contains an α-type phthalocyanine-based blue pigment, the content ratio of the α-type phthalocyanine-based blue pigment is preferably 2 to 15 mass %, and more preferably 4 to 12 mass %, relative to the mass of the entire layer of the polyurethane skin film, from the viewpoint that the polyurethane skin film is colored brightly, and is less likely to cause color migration.

For the polyurethane skin film, a diketopyrrolopyrrole-based red pigment and an α-type phthalocyanine-based blue pigment may be used in combination, or they may be used in combination with an additional pigment. Specific examples the additional pigment include a disazo-based pigment, a polyazo-based pigment, an anthraquinone-based pigment, a quinacridone-based pigment, iron oxide, titanium oxide, and carbon black.

The content ratio of all pigments, including the diketopyrrolopyrrole-based red pigment or the α-type phthalocyanine-based blue pigment, in the polyurethane skin film is preferably 1 to 30 mass %, and more preferably 2 to 20 mass %, relative to the mass of the entire layer of the polyurethane skin film, from the viewpoint that the polyurethane skin film is colored brightly, and is less likely to cause color migration.

The overall thickness of the polyurethane skin film is preferably 10 to 100 μm, and more preferably 20 to 50 μm. When the polyurethane skin film is too thin, the coloring strength or the abrasion resistance tends to be reduced. When the polyurethane skin film is too thick, the texture tends to be hard, or the bending resistance tends to be reduced.

For example, in the case of producing a grain-finished leather-like sheet having a layer configuration as that of the grain-finished artificial leather 10, examples of the method for bonding the polyurethane skin film to the surface of the polyurethane porous layer or the polyurethane non-porous layer include the following method using dry forming.

A polyurethane film for forming a polyurethane skin film containing a diketopyrrolopyrrole-based red pigment or an α-type phthalocyanine-based blue pigment is formed on release paper. Note that when the polyurethane skin film containing a diketopyrrolopyrrole-based red pigment or an α-type phthalocyanine-based blue pigment has a stacked structure including a polyurethane intermediate layer and a polyurethane outermost layer attached to the polyurethane intermediate layer, for example, a film of the polyurethane outermost layer containing a diketopyrrolopyrrole-based red pigment or an α-type phthalocyanine-based blue pigment is formed on the release paper, and a polyurethane film for forming the polyurethane intermediate layer containing a diketopyrrolopyrrole-based red pigment or an α-type phthalocyanine-based blue pigment is formed on the film of the polyurethane outermost layer, whereby a polyurethane skin film having a stacked structure of the polyurethane outermost layer and the polyurethane intermediate layer and containing a diketopyrrolopyrrole-based red pigment or an α-type phthalocyanine-based blue pigment is formed.

Then, a polyurethane adhesive is applied to the polyurethane skin film, then the solvent is completely or incompletely removed, and the polyurethane adhesive is dried. Then, the polyurethane adhesive stacked on the polyurethane skin film thus formed on the release paper is attached to the surface of the polyurethane porous layer, and then pressed, followed by curing the polyurethane adhesive, thus bonding the polyurethane skin film via the polyurethane adhesion layer.

The thickness of the polyurethane adhesion layer is not particularly limited, but is preferably 5 to 200 μm, and more preferably 30 to 70 μm. When the polyurethane adhesion layer is too thick, the bending resistance tends to be reduced, resulting in a reduction in the bonding strength of the polyurethane skin film. The total thickness of the polyurethane skin film and the polyurethane adhesion layer is preferably about 10 to 300 μm, more preferably about 30 to 200 μm, and particularly preferably about 50 to 100 μm, from the viewpoint that the balance between the mechanical properties and the texture can be maintained.

Then, the release paper is released from the surface of the polyurethane skin film, whereby the polyurethane skin film containing a diketopyrrolopyrrole-based red pigment or an α-type phthalocyanine-based blue pigment is stacked on the porous layer.

Instead of using the above-described dry forming, the polyurethane skin film containing a diketopyrrolopyrrole-based red pigment or an α-type phthalocyanine-based blue pigment may be formed by using a method in which a polyurethane-containing resin solution to which a diketopyrrolopyrrole-based red pigment or an α-type phthalocyanine-based blue pigment is mixed is applied to the surface of a polyurethane porous layer or a polyurethane non-porous layer by a gravure method, reverse coating, direct coating, or the like, and the polyurethane elastic polymer is wet-coagulated or dry-coagulated.

Also, referring to the layer configuration of the grain-finished artificial leather 10 shown in FIG. 1, the grain-finished leather-like sheet according to the present embodiment further includes a clear polyurethane film layer 5 coating the polyurethane skin film containing at least one of a diketopyrrolopyrrole-based red pigment or an α-type phthalocyanine-based blue pigment.

Here, a clear polyurethane film layer refers to a film layer that is in a state in which the color of the polyurethane skin film is visible, and is preferably a light-transmitting layer having a pigment content ratio of 1% or less, and more preferably a light-transmitting layer containing substantially no pigment, specifically, having a pigment content ratio of less than 0.1%.

Such a clear polyurethane film layer is formed, for example, by a method in which a polyurethane-containing resin solution containing substantially no pigment is applied to the surface of the polyurethane skin film by a gravure method, reverse coating, direct coating, or the like, and the resin solution is dried. Note that in the case of using a gravure method, it is preferable to repeatedly apply the resin solution so as not to leave any uncoated parts.

There is no particular limitation on the thickness of the clear polyurethane film layer as long as the grain-finished leather-like sheet has a grade of color difference, determined using a Grey scale for assessing staining, of 4-5 or more, when 0.03 g of oleic acid is added dropwise to a surface of the clear polyurethane film layer, and thereafter a white cotton fabric is reciprocated 100 times on the surface under a load of 9 N and at 20° C., a friction distance of 10 cm, and a friction speed of one reciprocation per second, using a crockmeter compliant with JIS L 0849. Specifically, the thickness is, for example, preferably 1 to 20 μm, and more preferably 2 to 5 μm.

Although the kind of the polyurethane for forming the clear polyurethane film layer is not particularly limited, a silicone-modified polyurethane is particularly preferable in that color migration to clothing under the effect of sebum can be easily suppressed because of the excellent sliding properties.

The grain-finished leather-like sheet according to the present embodiment described above is a grain-finished leather-like sheet that includes a polyurethane skin film containing at least one of a diketopyrrolopyrrole-based red pigment and an α-type phthalocyanine-based blue pigment, and that is less likely to cause color migration to clothing under the effect of sebum. Specifically, the unlikeliness to cause color migration to clothing under the effect of sebum is determined as follows.

The grain-finished leather-like sheet according to the present invention is a grain-finished leather-like sheet that has a grade of color difference, determined using a Grey scale for assessing staining, of 4-5 or more, when 0.03 g of oleic acid is added dropwise to a surface of the clear polyurethane film layer, and a predetermined white fabric is reciprocated 100 times on the surface under a load of 9 N and at 20° C., a friction distance of 10 cm, and a friction speed of one reciprocation per second, using a crockmeter compliant with JIS L 0849. Such a grain-finished leather-like sheet was obtained according to the following evaluation method.

Oleic acid is added dropwise to a surface of a colored grain-finished leather-like sheet, a white cotton fabric is reciprocated, using a crockmeter, a predetermined number of times on the surface of the grain-finished leather-like sheet to which oleic acid has been added dropwise, and thereafter the grade of color difference is determined using a Grey scale for assessing staining.

Oleic acid has properties similar to those of sebum. The amount of dropwise addition of oleic acid is not particularly limited, but is, for example, preferably about 0.01 to 0.05 g, and more preferably about 0.03±0.01 g.

Then, oleic acid is added dropwise to the colored grain-finished leather-like sheet, which is then allowed to stand for about 5 to 10 seconds, and a white cotton fabric is reciprocated a predetermined number of times on the surface of the colored grain-finished leather-like sheet, using a crockmeter.

Conditions including, for example, the load applied to the crockmeter, the environmental temperature, and the friction speed are set as appropriate according to the purpose of the grain-finished leather-like sheet to be evaluated, and the conditions are, for example, preferably a load of 9 N, 20° C., a friction distance of 10 cm, and a friction speed of one reciprocation per second. The number of times of reciprocation of the white cotton fabric using the crockmeter is also set as appropriate according to the purpose of the grain-finished leather-like sheet to be evaluated, and is preferably 10 to 200, for example. Then, after rubbing the surface to which the oleic acid has been added dropwise through a predetermined number of times of reciprocation using the crockmeter, the color migration to the white cotton fabric is evaluated. Specifically, the grade of color difference is determined using a Grey scale for assessing staining.

As for the method for determining the grade of color difference using a Grey scale for assessing staining, for example, it is preferable that the grain-finished leather-like sheet has a grade of color difference of 4-5 or more, when about 0.03±0.01 g of oleic acid is added dropwise to a surface of the clear polyurethane film layer, and a white cotton fabric is reciprocated 100 times on the surface under a load of 9 N and at 20° C., a friction distance of 10 cm, and a friction speed one reciprocation per second, using a crockmeter compliant with JIS L 0849, because it can be determined that the grain-finished leather-like sheet is sufficiently unlikely to cause color migration to clothing under the effect of sebum.

The grain-finished leather-like sheet according to the present invention described above can be preferably used as a skin material for bags, clothing, shoes, and the like. In particular, the grain-finished leather-like sheet can be preferably used as the material of Randoserus colored in bright red, blue, or the like.

EXAMPLES

Hereinafter, the present invention will be described in further detail by way of examples. It should be appreciated that the scope of the invention is by no means limited to the examples.

[Preliminary Survey]

A follow-up survey was conducted for a plurality of monitors who had used for several years a Randoseru using a grain-finished leather-like sheet for the back lining portion thereof, and the monitors were asked about the occurrence of an event that color migration had occurred when they wore a mesh T-shirt. Then, the clothing to which color had migrated was collected. Then, it was identified that the color migration to the T-shirts was in many cases caused by a book satchel whose back lining portion was formed of a grain-finished leather-like sheet colored with a diketopyrrolopyrrole-based red pigment or an α-type phthalocyanine-based blue pigment. Note that it was detected that only few of the grain-finished leather-like sheets colored with a diketopyrrolopyrrole-based red pigment or an α-type phthalocyanine-based blue pigment caused color migration, and that all of the clothing to which color had migrated contained a large amount of component of sebum.

Example 1

Island-in-the-sea composite fibers composed of 60 parts by mass (island component) of 6-nylon and 40 parts by mass of a high-fluidity, low-density polyethylene (sea component) were spun by melt spinning, and the fibers were stretched 2.5 times in warm water at 70° C. A fiber oil solution was applied to the stretched island-in-the-sea composite fibers, which were then mechanically crimped, and dried. Then, the mechanically crimped island-in-the-sea composite fibers were cut into 51 mm, to give staple fibers with 4 dtex. A web of the staple fibers that had a basis weight of 600 g/m$^2$ of was formed by a scrap method, and the web was needle punched alternately from both sides thereof at a total density of about 500 punch/cm$^2$. Furthermore, the web was heated to 120° C., and pressed using a calendar roll, thus forming an entangled non-woven fabric having a smooth surface. The entangled non-woven fabric had a basis weight of 400 g/m$^2$ and an apparent specific gravity of 0.3 g/cm$^3$.

Then, after the entangled non-woven fabric had been impregnated with a dimethylformamide (DMF) solution of a polyurethane, composed mainly of a polytetramethylene ether-based polyurethane and having a concentration of 13%, the entangled non-woven fabric was immersed in a liquid mixture of DMF/water=15/85, to wet-coagulate the polyurethane into a porous form, thus forming a polyurethane porous layer so as to be stacked on the entangled non-woven fabric. Then, the entangled non-woven fabric on which the polyurethane porous layer had been stacked was treated in hot toluene, to remove the sea component in the island-in-the-sea composite fibers by dissolution, thus generating ultrafine fibers having a fineness of 0.05 dtex. In this manner, a sheet material having a thickness of 1.4 mm and a polyurethane basis weight of 160 g/m$^2$ was obtained. Then, the obtained sheet material was sliced into two halves, and the sliced surface was buffed, thus obtaining an artificial leather base material including a non-woven fabric of the ultrafine fibers and a polyurethane porous layer stacked on the non-woven fabric, and having a thickness 0.6 of mm.

Meanwhile, a DMF solution of a polyurethane composition that contained 100 parts by mass of a hardly yellowing polycarbonate-based polyurethane solution (resin content: 30%), 10 parts by mass of a red vehicle containing 14 mass % of a diketopyrrolopyrrole-based red pigment, 10 parts by mass of a red vehicle containing 15 mass % of an anthraquinone-based red pigment, 5 parts by mass of a white vehicle containing 50 mass % of titanium oxide, 30 parts by mass of DMF, and 30 parts by mass of methyl ethyl ketone was applied onto release paper (AR99SM manufactured by ASAHI ROLL CO., LTD.) such that the thickness after drying was 15 μm, and dried, to form a polyurethane outermost layer.

Then, the same DMF solution of a polyurethane composition as that used for the outermost layer was applied onto the surface of the polyurethane outermost layer of the release paper such that the thickness after drying was 20 μm, and dried, to form a polyurethane intermediate layer. In this manner, a polyurethane skin film that was a stack of the polyurethane outermost layer and the polyurethane intermediate layer, and that contained 3.8 mass % of the diketopyrrolopyrrole-based red pigment was formed.

Then, 130 g/m$^2$ of a polyurethane-based adhesive solution obtained by adding a crosslinking agent and a crosslinking accelerator to 100 parts by mass of a crosslinkable polyurethane-based adhesive solution, and further mixing thereto 5 parts by mass of DMF and 10 parts by mass of ethyl acetate was applied onto the surface of the polyurethane intermediate layer of the polyurethane skin film, and dried at 120° C. for 15 seconds to evaporate the solvent, thus forming an uncured adhesive layer having a thickness of 50 μm. Then, the uncured adhesive layer was attached to the polyurethane porous layer, and the whole was pressed using rolls with a clearance corresponding to 65% of a total thickness of the artificial leather base material provided therebetween, and thereafter dried at 130° C. for 3 minutes. Then, further, the whole was aged at 50° C. for 3 days, and thereafter the release paper was released, thus exposing the polyurethane skin film to the outside.

Then, a silicone-modified hardly yellowing polyester-based polyurethane (LEATHEROID SP-215 manufactured by Dainichiseika Color & Chemicals Mfg. Co., Ltd.) having a 100% modulus of 19 MPa was applied in two coats in an amount of 4 g/m$^2$ as a solid content using a 150-mesh gravure roll, without generating any uncoated parts, and dried, to form a clear polyurethane film layer coating the polyurethane skin film and having a thickness of about 3 μm. In this manner, a grain-finished artificial leather that was a grain-finished leather-like sheet was obtained.

Then, 0.03±0.01 g of oleic acid was added dropwise to the surface of the clear polyurethane film layer of the grain-finished artificial leather, which was then allowed to stand for 5 seconds to 10 seconds, and thereafter a white cotton fabric was reciprocated 100 times on the surface under a load of 9 N and at 20° C., a friction distance of 10 cm, and a friction speed of one reciprocation per second, using a crockmeter compliant with JIS L 0849. The grain-finished artificial leather had a grade of color difference, determined using a Grey scale for assessing staining defined in JIS L 0805, of 4-5.

Example 2

A grain-finished artificial leather was obtained in the same manner as in Example 1 except that the formation of the polyurethane skin film of the grain-finished artificial leather of Example 1 was changed in the following manner, and the obtained grain-finished artificial leather was evaluated.

A DMF solution of a polyurethane composition that contained 100 parts by mass of a hardly yellowing polycarbonate-based polyurethane solution (resin content: 30%), 18 parts by mass of a blue vehicle containing 20 mass % of an α-type phthalocyanine copper-based blue pigment, 4 parts by mass of a white vehicle containing 50 mass % of titanium oxide, 30 parts by mass of DMF, and 30 parts by mass of methyl ethyl ketone was applied onto release paper (AR99SM manufactured by ASAHI ROLL CO., LTD.) such that the thickness after drying was 15 μm, and dried, to form a polyurethane outermost layer.

Then, the same DMF solution of a polyurethane composition as that used for the outermost layer was applied onto the surface of the polyurethane outermost layer of the release paper such that the thickness after drying was 20 μm, and dried, to form a polyurethane intermediate layer. In this manner, a polyurethane skin film that was a stack of the polyurethane outermost layer and the polyurethane intermediate layer and that contained 9.7 mass % of the α-type phthalocyanine-based blue pigment was formed.

The grain-finished artificial leather had a grade of color difference, determined using a Grey scale for assessing staining defined in JIS L 0805, of 4-5 to 5.

Example 3

A grain-finished artificial leather including a clear polyurethane film layer having a thickness of about 4 μm was obtained in the same manner as in Example 1 except that a hardly yellowing polyether-based polyurethane having a 100% modulus of 6 MPa was applied in two coats in an amount of 4 g/m$^2$ as a solid content using a 150-mesh gravure roll in the formation of the clear polyurethane film layer of the grain-finished artificial leather of Example 1, instead of applying the silicone-modified hardly yellowing polyester-based polyurethane having a 100% modulus of 19 MPa in two coats in an amount of 4 g/m$^2$ as a solid content using a 150-mesh gravure roll, and the obtained grain-finished artificial leather was evaluated.

The grain-finished artificial leather had a grade of color difference, determined using a Grey scale for assessing staining defined in JIS L 0805, of 4-5.

Example 4

As the release paper in Example 1, R51 manufactured by LINTEC Corporation, which had irregularities including deep recesses was used in place of AR99SM manufactured by ASAHI ROLL CO., LTD. In the formation of the clear polyurethane film layer, a hardly yellowing polycarbonate-based polyurethane solution (resin content: 20%) was applied in an amount of 80 g/m$^2$ using a reverse coater, and dried at 120° C., to obtain a grain-finished artificial leather including the clear polyurethane film layer, and the obtained grain-finished artificial leather was evaluated.

The grain-finished artificial leather had a grade of color difference, determined using a Grey scale for assessing staining defined in JIS L 0805, of 5.

Comparative Example 1

A grain-finished artificial leather including a clear polyurethane film layer having a thickness of about 1 μm was obtained in the same manner as in Example 1 except that a silicone-modified hardly yellowing polyester-based polyurethane having a 100% modulus of 19 MPa was applied in one coat in an amount of 1 g/m$^2$ as a solid content using a 150 mesh gravure roll in the formation of the clear polyurethane film layer of the grain-finished artificial leather in Example 1, instead of applying the polyurethane in two coats in an amount of 4 g/m$^2$ as a solid content, and the obtained grain-finished artificial leather was evaluated.

The grain-finished artificial leather had a grade of color difference, determined using a Grey scale for assessing staining defined in JIS L 0805, of 3-4.

Comparative Example 2

A grain-finished artificial leather was obtained in the same manner as in Example 1 except that, as the release paper in Example 1, R51 manufactured by LINTEC Corporation, which had irregularities including deep recesses, was used in place of AR99SM manufactured by ASAHI ROLL CO., LTD., and the obtained grain-finished artificial leather was evaluated. The grain-finished artificial leather had a grade of color difference, determined using a Grey scale for assessing staining defined in JIS L 0805, of 3.

Comparative Example 3

A grain-finished artificial leather including a clear polyurethane film layer having a thickness of about 1 μm was obtained in the same manner as in Example 2 except that a silicone-modified hardly yellowing polyester-based polyurethane having a 100% modulus of 19 MPa was applied in one coat in an amount of 1 g/m$^2$ as a solid content using a 150-mesh gravure roll in the formation of the clear polyurethane film layer of the grain-finished artificial leather of Example 2, instead of applying the polyurethane in two coats in an amount of 4 g/m$^2$ as a solid content, and the obtained grain-finished artificial leather was evaluated.

The grain-finished artificial leather had a grade of color difference, determined using a Grey scale for assessing staining defined in JIS L 0805, of 3.

The grain-finished artificial leathers obtained in Examples 1 to 4 had a grade of color difference, determined using a Grey scale for assessing staining defined in JIS L 0805, of 4-5 or more, when 0.03 g of oleic acid was added dropwise to the surface of the clear polyurethane film layer, and thereafter a white cotton fabric was reciprocated 100 times on the surface under a load of 9 N and at 20° C., a friction distance of 10 cm, and a friction speed of one reciprocation per second, using a crockmeter compliant with JIS L 0849. The occurrence of color migration is suppressed for such a grain-finished artificial leather even when the grain-finished artificial leather is used for the back lining portion of a Randoseru. On the other hand, when the clear polyurethane film layer was applied in one coat as in the case of the conventional grain-finished artificial leathers obtained in Comparative Examples 1 and 3, the grain-finished artificial leathers had a grade of color difference, determined using a Grey scale for assessing staining defined in JIS L 0805, of less than 4-5. When the recesses of the irregularities of the release paper were deep as in the case of the grain-finished artificial leather obtained in Comparative Example 2, the grain-finished artificial leather had a grade of color difference, determined using a Grey scale for assessing staining defined in JIS L 0805, of 3. In the case of Comparative Example 2, the grade of color difference determined was 3 presumably because the polyurethane solution was able to be applied only on the projections using the gravure roll.

REFERENCE SIGNS LIST

1 . . . . Fiber base material
2 . . . . Polyurethane porous layer
3 . . . . Polyurethane adhesion layer
4 . . . . Polyurethane skin film
5 . . . . Clear polyurethane film layer
10 . . . . Grain-finished leather-like sheet

The invention claimed is:

1. A grain-finished leather-like sheet comprising:

a fiber base material, a polyurethane porous layer stacked on the fiber base material, a polyurethane skin film stacked on the polyurethane porous layer via a polyurethane adhesion layer, and a clear polyurethane film layer coating the polyurethane skin film, wherein:

the fiber base material comprises fibers having a fineness of less than 1 dtex;

the polyurethane porous layer has a thickness from 100 to 600 μm, the polyurethane skin film has a thickness from 10 to 100 μm, the polyurethane adhesion layer has a thickness from 5 to 200 μm, and the clear polyurethane film layer has a thickness from 1 to 20 μm;

the polyurethane skin film comprises at least one of a diketopyrrolopyrrole-based red pigment and an α-type phthalocyanine-based blue pigment; and the grain-finished leather-like sheet has a grade of color difference, determined using a Grey scale for assessing staining defined in JIS L 0805, of 4-5 or more, when 0.03 g of oleic acid is added dropwise to a surface of the clear polyurethane film layer, and thereafter a white cotton fabric is reciprocated 100 times on the surface under a load of 9 N and at 20° C., a friction distance of 10 cm, and a friction speed of one reciprocation per second, using a crockmeter compliant with JIS L 0849.

2. The grain-finished leather-like sheet according to claim 1, wherein the clear polyurethane film layer comprises a silicone-modified polyurethane.

3. The grain-finished leather-like sheet according to claim 1, wherein the polyurethane skin film comprises 1 to 8 mass % of the diketopyrrolopyrrole-based red pigment, or comprises 2 to 15 mass % of the α-type phthalocyanine-based blue pigment.

4. The grain-finished leather-like sheet according to claim 2, wherein the polyurethane skin film comprises 1 to 8 mass % of the diketopyrrolopyrrole-based red pigment, or comprises 2 to 15 mass % of the α-type phthalocyanine-based blue pigment.

5. The grain-finished leather-like sheet according to claim 1, wherein the polyurethane skin film comprises 2 to 6 mass % of the diketopyrrolopyrrole-based red pigment.

6. The grain-finished leather-like sheet according to claim 1, wherein the polyurethane skin film comprises 4 to 12 mass % of the α-type phthalocyanine-based blue pigment.

7. The grain-finished leather-like sheet according to claim 1, wherein the polyurethane skin film has a thickness from 20 to 50 μm.

8. The grain-finished leather-like sheet according to claim 1, wherein the clear polyurethane film layer comprises 1 mass % or less of pigments.

9. The grain-finished leather-like sheet according to claim 1, wherein the clear polyurethane film layer has a thickness from 2 to 5 μm.

10. The grain-finished leather-like sheet according to claim 1, wherein the fiber base material has a thickness from 300 to 3000 μm.

11. The grain-finished leather-like sheet according to claim 1, wherein the fiber base material comprises at least one selected from the group consisting of nylon-based fibers, polyester-based fibers, polyolefin-based fibers, and polyurethane-based fibers.

12. The grain-finished leather-like sheet according to claim 1, wherein the clear polyurethane film layer consists of a polyurethane resin and less than 0.1% pigment.

* * * * *